United States Patent [19]

Lang et al.

[11] Patent Number: 4,792,680

[45] Date of Patent: Dec. 20, 1988

[54] CORONA DEVICE HAVING A BERYLLIUM COPPER SCREEN

[75] Inventors: Joseph H. Lang, Webster; David J. McEwen, Palmyra; John J. Meyer, Rochester, all of N.Y.

[73] Assignee: Xerox Corporation, Stamford, Conn.

[21] Appl. No.: 2,100

[22] Filed: Jan. 12, 1987

[51] Int. Cl.[4] ..... H01T 19/00; G03G 15/02

[52] U.S. Cl. ..... 250/325; 250/324; 355/3 CH; 361/229; 361/230

[58] Field of Search ..... 250/324, 325, 326; 355/3 CH; 361/229, 230

[56] References Cited

U.S. PATENT DOCUMENTS

| | | | |
|---|---|---|---|
| 2,189,971 | 2/1940 | Warnecke | 250/174 |
| 4,585,320 | 4/1986 | Altavela et al. | 355/3 CH |
| 4,585,322 | 4/1986 | Reale | 355/3 CH |
| 4,585,323 | 4/1986 | Ewing et al. | 355/3 CH |
| 4,591,713 | 5/1986 | Gundlach et al. | 250/326 |

OTHER PUBLICATIONS

"Beryllium Copper"; John T. Richards et al; Materials & Methods Manual; The Brush Beryllium Co., Apr. 1950; pp. 76-90.

*Primary Examiner*—Bruce C. Anderson
*Assistant Examiner*—Jack I. Berman
*Attorney, Agent, or Firm*—Mark Costello

[57] ABSTRACT

A scorotron screen for use in a negative corona scorotron charging device comprises a beryllium copper alloy which reduces the problems associated with parking deletions in elecrophotographic process. The screen is fabricated by stamping from beryllium copper sheet metal. Heating the stamped member to a stress relieving temperature induces a tension on the member which enhances flatness.

7 Claims, 2 Drawing Sheets

CORONA DEVICE HAVING A BERYLLIUM COPPER SCREEN

Figure 1:
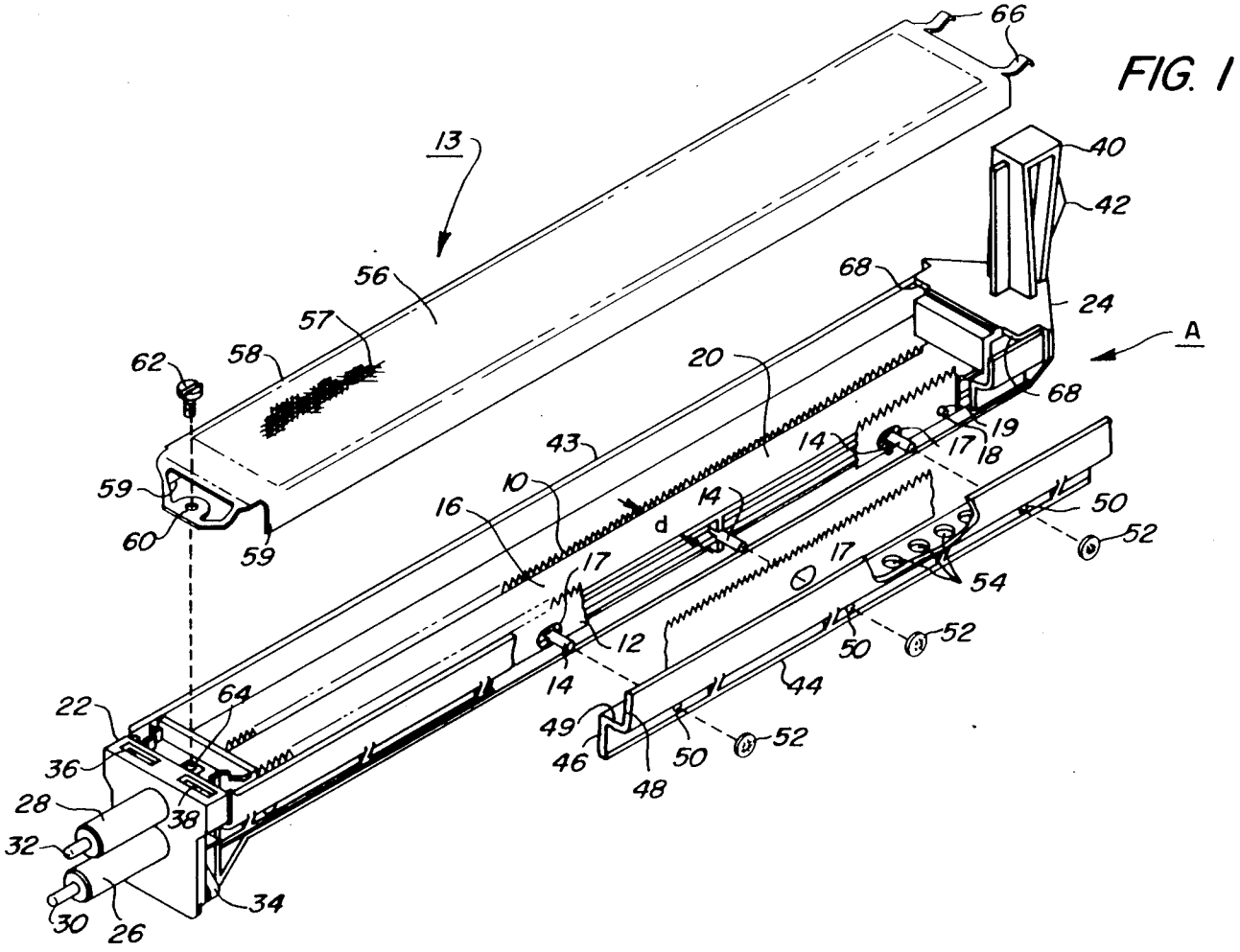

This invention relates generally to corona devices for charging insulating surfaces and more particularly to an improved scorotron for charging a photoconductive surface in an electrophotographic machine, and a method of manufacturing thereof.

CROSS REFERENCE TO RELATED APPLICATIONS

Cross reference is hereby made to U.S. patent applications Ser. Nos. 750,845, 881,144 and 881,142, now U.S. Pat. Nos. 4,646,196, 4,725,732, and 4,725,731, respectively, assigned to the same assignee as the present application.

INCORPORATION BY REFERENCE

U.S. Pat. No. 4,646,196, assigned to the same assignee as the present application, is incorporated herein by reference for the purpose of background information.

BACKGROUND OF THE INVENTION

During electrophotographic processes such as xerography, it is necessary to apply a uniform level of charge to a photoconductive surface of a photoreceptor, which charge will subsequently be selectively dissipated by exposure to light, as part of the electrophotographic process. The non-discharged portions retain their charge in the form of a latent image on the photoconductive surface, and, when subsequently brought into contact with toner material, will retain toner on the photoconductive surface in the areas where the charge has not been dissipated. In a commonly used corona discharge device, (referred to hereinafter as a corotron), a high voltage in the range of ±5000 to 8000 volts is applied to a coronode, comprising, for example, a thin bare conductive wire or an array of pins integrally formed from a sheet metal member, supported between insulating end blocks, and mounted within a conductive channel or shield and held closely adjacent to the surface to be charged to create a corona spray which imparts electrostatic charge to the surface. In another similar device, (referred to hereinafter as a scorotron) providing more uniform charging and preventing over charging, a corona charging device is provided with a screen or control grid held at a uniform lower potential, approximating the charge level to be placed on the photoconductive surface, and disposed between the coronode and the surface to be charged.

It has been found that when using corona generating devices that produce a negative corona, desirable for use particularly with photoconductive surfaces operating with a negatively charged surface, certain difficulties may be observed. It is believed that various nitrogen oxide species are produced by the corona, and that these nitrogen oxide species are adsorbed by solid surfaces. In particular, it is believed that these species are adsorbed by the conductive shield, the housing and the screen or control grid of the corona generating device. This adsorption occurs despite the fact that, during operation of an electrophotographic machine, the corona generating device may be provided with a directed air flow to remove nitrogen oxide species as well as ozone from the area adjacent the corona generating device. After exposure to the nitrogen oxide species, when the electrophotographic machine is turned off for an extended period, and corona is not produced by the corona generating device, the adsorbed nitrogen oxide species are gradually desorbed, i.e., the adsorption is a physically reversible process. When operation of the machine is resumed, a copy quality defect is observed in the copies produced, comprising a line image deletion or lower density image formed across the photoconductive surface at the portion of the surface which was at rest opposite the corona generating device during the period of idleness.

While the mechanism of the interaction of the desorbed nitrogen oxide species and the photoconductive surface is not fully understood, it is believed that the oxide species in some way interact with the photoconductive surface, increasing lateral conductivity so that the surface cannot retain a charge in image fashion for development with toner. This causes narrow line images to blur or to wash out and remain undeveloped after toner is brought into contact with the surface. This defect, sometimes referred to as "parking deletion", increases in severity with prolonged exposure of the photoconductive surface to the desorbing nitrogen oxide species during extended periods of idleness. This problem has been observed even after a relatively short period of operation, coupled with an extended period of idleness.

During the initial stage of exposure of the photoconductive surface to the desorbing nitrogen oxide species, it is possible to rejuvenate the photoconductive surface by washing the surface with alcohol, since reaction between the surface and the nitrogen oxide species tends to remain, initially, at the surface. However, after a prolonged period of time the reaction tends to penetrate the photoconductive surface through the layers of the photoreceptor, and cannot be washed off with the solvent. The defect is reversible to some degree by a rest period. However, the period involved may be of the order of several days, which to an operator is objectionable. Frequent cleaning of the photoconductive surface is also undesirable, as it allows the possibility of damage and wear to the photoconductive surface.

Where a scorotron is used for charging a photoconductive surface, it has been found that the material from which the scorotron screen is fabricated has a significant effect on the severity of parking deletions. Heretofore, a stainless steel screen or grid has commonly been used. Other materials have been proposed, without substantial success, such as Monel, Inconel or other corrosion resistant ferrous materials which prevent the rapid oxidation of the screen material and the concurrent loss of performance characteristic of the scorotron due primarily to the corrosive effect of negative corona produced by the device. Stainless steel screens have been used primarily due to the price/performance characteristics of the material. In positive charging devices, not subject to the particularly corrosive negative corona effects, copper screening has been used to some success. To reduce the deletion problem associated with negative corona scorotron charging, considerable work has been done to reduce the adsorption of nitrogen oxide species by the stainless steel screen by applying electrodag coatings to the screen surface. Such coatings typically include a reactive metal base such as nickel, lead, copper, nickel or zinc or mixtures thereof, which tend to absorb or form harmless compounds with the nitrogen oxide species. While some success has been found using this approach, parking deletions have continued as a problem, due to the failure of the electrodag materials to continue to absorb or form harmless compounds with the nitrogen oxide species over time. Additionally, the stainless steel screen itself is somewhat expensive to fabricate, generally requiring photoetching or chemical milling to achieve the desired mechanical tolerances. These processes are, by nature, relatively expensive. High quality stamping is useful, and less expensive, requiring a first perforating and forming step, forming the screen from stainless steel sheet metal, and a second custom flattening step to achieve the high degree of flatness required for the screen. However, even with the custom flattening step, the required flatness is often not achieved. Subsequent to fabrication of the screen, the reactive metal base coatings are applied. Of course, other grid arrangements may be used, including a screen comprising closely spaced wires. However, the described arrangement offers advantages in manufacturing and operation.

Beryllium copper is known for use in pin array coronode members, such as that described for the scorotron arrangement taught in U.S. Pat. No. 4,591,713 to Gundlach et al and assigned to the same assignee as the present application. Beryllium copper has a known anti-corrosive nature, a high degree of conductivity, and is highly formable at relatively low temperatures, as described in "Beryllium Copper", Materials & Methods Manual, The Brush Beryllium Company, April, 1950. Beryllium copper is also known for good thermal stability for use as an electrode in a vacuum tube, as shown in U.S. Pat. No. 2,189,971 to Warnecke.

SUMMARY OF THE INVENTION

It therefore a primary object of the invention to provide a corona charging device which advantageously reduces the problem associated with parking deletions.

It is another object of the invention to provide scorotron having a scorotron screen which is relatively inexpensive to fabricate.

It is yet another object of the invention to provide a scorotron screen which is relatively insensitive to corona conditions, produces few corona by-products, has a long life, and maintains a high degree of operativeness.

In accordance with the invention, there is provided a corona generating device for charging a photoconductive surface in an electrophotographic device, including an insulative support member; an elongated coronode supported on the support member, closely adjacent and generally parallel to a photoconductive surface; a first voltage source, connected to the coronode for driving the coronode to a corona generating condition; a screen supported on the support member between the coronode and the photoconductive surface; a second voltage source, connected to the screen for driving the screen to a potential approximating the desired potential on the surface; the screen comprising a beryllium copper alloy. Beryllium copper is believed to have the characteristic of resistance to the adsorption of nitrogen oxide species. As the screen constitutes the portion of the scorotron closest to the photoconductive surface, nitrogen oxide species released or desorbed in conductive surface. Accordingly, reduction in nitrogen oxide species at the scorotron screen has the potential of significantly reducing the deletion problem.

In accordance with another aspect of the invention, a scorotron screen may comprise a generally elongated rectangular member having a thin cross sectional thickness, and fabricated from a beryllium copper alloy. The member is provided with a substantially planar portion, having a grid portion including a number of openings through the cross-sectional thickness of the member, the openings forming an open area in the range of approximately 40–70% of the grid portion, and a frame portion about the periphery of the planar portion. The screen may be advantageously perforated and formed from beryllium copper sheet metal, and heat treated for stress relief. It is a characteristic of beryllium copper that it regains flatness after the heat treating step. Further, a slight shrinkage associated with heating induces a tension on the grid portion of the member, enhancing and maintaining flatness. The improvement in flatness maintenance allows the final flattening step required in the production of stainless steel screens to be avoided. Thus, while the cost of beryllium copper material is commonly higher than stainless steel, the higher cost is somewhat offset by a reduction in the cost of fabrication.

Figure 2:
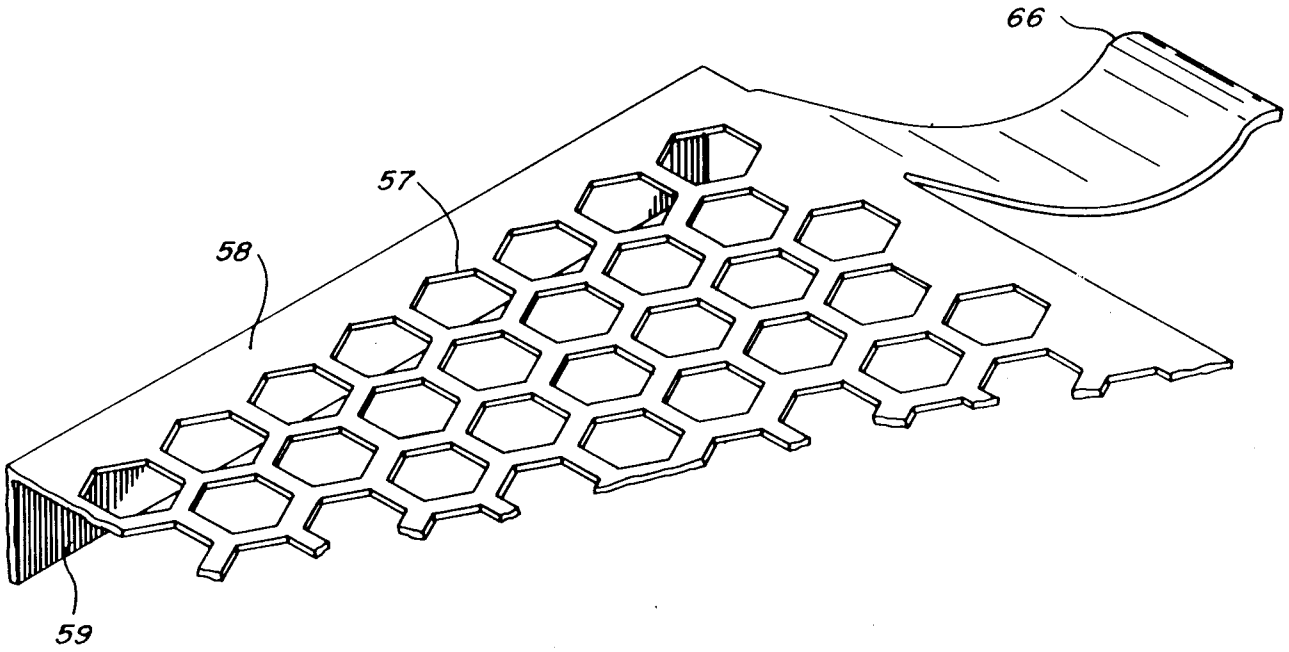

These and other objects and advantages will become apparent as the following description is reviewed in conjunction with the accompanying drawings in which:

FIG. 1 is a perspective exploded and sectional view of a scorotron and screen in accordance with the invention; and FIG. 2 is a sectional view of a preferred embodiment of the screen.

Referring now to the drawings, wherein the showings are for the purpose of illustrating a preferred embodiment of the invention and not for the purpose of limiting same, FIG. 1 shows a scorotron-type corona generating device. Scorotron A, as shown in FIG. 1, is characterized by having two saw tooth pin array coronodes 10 and 12, and a screen or grid 13 disposed between the pin array coronodes and the surface to be charged (not shown). The scorotron pin array coronodes 10 and 12 may be supported on support projections 14 and 18 extending outwardly in opposing directions from either side of a central insulative support member 16 at generally corresponding positions, separated by the width of support member 16 to maintain the coronode members 10 and 12 spaced a distance d apart. Support projections 14 extend through coronode support openings 17, spaced along the coronodes 10 and 12 and slightly larger than the support projections to allow a loose fit for adjustment in the placement of the coronode members with respect to the scorotron. The distance d is chosen to be as large as possible consistent with the need for a compact device, as smaller d spacings require greater power levels to drive the scorotron to corona producing conditions. Support projections 14 and locator pin member 18 are provided on support member 16 to correctly position pin array coronode 10 with respect thereto, while another locator pin member (not shown) is located at a slightly offset position on the opposite side of central support member 16 to position the otherwise generally identical pin array coronode 12 in an offset position from pin array coronode 10. The locator pin members extend through a locator pin opening 19 on each coronode which tightly fits over the locator pin member to locate or position the coronodes. Coronodes 10 and 12 and the arrangement for supporting them with respect to the photoconductive surface are described in terms of a preferred embodiment only. The invention has equal applicability, for example, to scorotrons with a single or multiple coronodes, thin bare wire coronodes, dielectric coated wire coronodes or discrete pins in an array, and other support arrangements accomplishing the support of the coronodes and screen with respect to the photoconductive surface, or surface to be charged.

Central support member 16 is provided with a coronode support portion 20 and mounting block members 22 and 24 on either end thereof. Support projections 14 extend outwardly from scorotron support portion 20, from either side thereof, in opposing directions. Mounting block 22 integrally supports contact support portions 26 and 28, each respectively supporting high voltage contact member 30, for connection of the pin array coronodes 10 and 12 to a high voltage source (not shown), and low voltage contact member 32 for connection of screen 13 to a low voltage source (not shown), as well as a locking spring member 34 which engages with receiving members (not shown) extending through locking spring slots 36 and 38 in mounting the scorotron in an electrophotographic machine assembly. Mounting block 24, supports an extension member 40 for insertion into a receiving slot (not shown) for mounting the scorotron into the electrophotographic machine assembly and to correctly position the scorotron for engagement with a spring biased locking member (not shown) on the main reproduction machine assembly, to lock the scorotron into position therein.

Scorotron side support members 43 and 44 are generally identical members, advantageously provided with a stepped cross section having first and second vertical portions 46 and 48, and a horizontal portion 49 joining them. First vertical portion 46 is provided with support projection receiving openings 50 corresponding to support projections 14. Pin array coronodes 10 and 12 are each supported on support projections 14, between central support member 16 and one of side support members 43 and 44, with the coronodes, side support members and central support members fixed into position with fasteners 52, fastened over support projections 14, and against side support members 43 and 44, to hold the assembly together, or by hot staking the support projections for the same purpose. One or both of scorotron side supports 43 and 44 may advantageously be provided with an opening or array of openings 54 along horizontal portion 49. Openings 54 in horizontal portion 49 of side support members 43 and 44 serve to aid in the removal of corona byproducts from the area between the coronodes and the surface to be charged, which may damage the photoconductive surface. Additionally, openings 54 serve to aid in the prevention of arcing from the coronodes along the surfaces of scorotron side supports 43 and 44 toward screen 13.

Screen 13 may comprise a generally elongated member with a generally U-shaped cross section. The member desirably has a cross-sectional thickness in the range of 0.002 to 0.0105 in., (0.051 to 0.267 mm.) with the limits of determined primarily by either mechanical properties of strength or cost of materials. A planar portion 56 is comprised generally of a grid portion 57 having approximately a 40–70% open area, and a frame portion 58, which may be solid, surrounding grid portion 57 about the periphery of planar portion 56. The upper limit of the grid open area is determined by mechanical properties of strength and desired current efficiency, while the an open area percentage below the lower grid open area limit causes inefficiency in operation of the corona generating device. Parallel flange portions 59 extend perpendicularly from planar portion 57 along the elongated edges thereof, which will fit inside second vertical portion 48 on side support member 43 and 44 to increase the current emitted by the coronode, thereby improving charging uniformity, and to aid in maintaining placement of screen 13 with respect to the scorotron assembly. Screen 13 is supported at either end on mounting blocks 22 and 24, and may advantageously be provided with a fastener receiving opening 60 disposed at one end of the screen 13 which receives a conductive fastener member 62 for connection through an opening 64 in mounting block 22 to low voltage potential contact member 32. Spring tongue members 60 are insertable into receiving openings 68 in mounting block member 24. The screen may be coated with any of several electrodag coatings, as described in U.S. Pat. Nos. 4,585,320 to Altavela et al, 4,585,322 to Reale, 4,585,323 to Ewing et al, or 4,646,196 to Reale. Typically, such coatings area applied to a thickness of about 0.0005 to 0.001 in. (0.0127 to 0.0254 mm.).

Referring to FIG. 2, grid portion 57 may advantageously be comprised of a closely spaced array of hexagonally shaped openings. This arrangement is preferred only for the purpose of ease of fabrication, strength of the grid portion, and efficiency in usage of space. Other arrangements could be used to same end without effecting operational characteristics of the screen.

In accordance with the invention, screen 13 is fabricated from a beryllium copper alloy. As the screen is the closest element of the scorotron to the photoconductive surface, nitrogen oxide species at the screen have a particularly deleterious effect. The fabrication of the screen from beryllium copper appears to have the effect of substantially reducing the presence of nitrogen oxide species in the area adjacent the screen, when compared to other materials such as stainless steel. In a preferred embodiment, the alloy used is designated as Copper Development Associates 172 (CDA 172) which comprises a copper and beryllium alloy in the range of 1.8% beryllium. Other alloys of beryllium copper may be used. While alloys of beryllium copper having higher percentages of beryllium have desirable anti-corrosion properties and anti-deletion properties, such alloys also have a reduced conductivity, which tends to cause inefficiency in charging operation. Additionally, alloys having a percentage of beryllium greater than about 2% are difficult to obtain in commercial quantities.

In fabricating the screen, the shape is formed in a series of stamping steps which variously stamp the periphery of the screen and perforate the openings, including the grid openings. Subsequent to forming, the screen is heated a stress relieving temperature to relieve stress caused by the perforation operation. It is a characteristic of beryllium copper, that upon heating, some shrinkage of the material is noted. It has been noted that the shrinkage induces a tensioning force on the grid portion. This tension acts to enhance and maintain flatness. Subsequent to heat treating, the flanged on the elongated edges of the screen may be formed, and the screen may be coated with an electrodag.

To assemble the scorotron, pin array coronodes members 10 and 12 are placed in position over support projections 14 and electrically connected, such as by soldering, into position with high voltage contact 32. The pin array coronodes are then secured into position on support projections 14 against central support portion 16 with side support members 43 and 44 with fasteners or hot staking the support projections. Screen 13 is attached to the scorotron assembly by insertion of spring tongue members 66 into receiving openings 68, and inserting conductive fastener 62 through fastener receiving opening 60 on screen 13 and receiving opening 64 on mounting block 22 for electrical connection of the screen to the low voltage contact member 32. The scorotron is held in position in the reproduction machine at the mounting block portions, disposed to provide the contact support portions available for a plug-type connection to a power source. For the purposes of charging the photoreceptor surface in a reproduction machine, a D.C. voltage of between −6.5 to −10 Kv is applied to the high voltage contact member, while a low D.C. voltage of −500 to −1500 v, or approximately the voltage level desired for the photoreceptor, is applied to the low voltage contact member.

Side support members 12 and 14 are advantageously manufactured with a non-conductive, somewhat rigid plastic material, which is injection molded to provide the desired shape. The conducive contact members may be easily molded into the support members simultaneously with their manufacture. In a preferred embodiment, the plastic is 30% glass filled to provide a degree of desired rigidity.

Tests comparing the deletion prevention characteristics of beryllium copper with respect to stainless steel were performed, using a selected electrodag coating. In the tests, similar scorotron screens were driven in a test fixture at common voltage levels of −1000 volts. Voltage was applied to the coronode to produce a −2 milliamp corona current. Testing was performed in a high humidity environment, conductive to the production of deletions. The screen was spaced 0.118 in (3 mm). from a bare aluminum surface. The screens were coated with a selected electrodag coating, as described. Periodically, the scorotrons were removed from the aging fixture, the pins cleaned, and the scorotrons inserted into a xerographic device. The scorotrons were allowed to "outgas" or desorb nitrogen oxide species for a selected period of time. Several copies of a test pattern were made and graded on the following scale:

level 0: No deletion visible on any copies.

level 1:
- Slight lightening of image
- Small in size: <3 in (76.3 mm) long × <1 in (25.4 mm) wide.

level 2:
- Moderate lightening of image
- Moderate in size: <6 in (152.4 mm) long × <1 in (25.4 mm) wide.

level 3:
- Moderate lightening of image with center of defect slightly darkened to near original image density.
- Moderate in size: <6 in (152.4 mm) long × <1 in (25.4 mm) wide.

level 4:
- Lightening of image at edges with center of defect noticeably darkened.
- Large size: >6 in (152.4 mm) long × >1 in (25.4 mm) wide.

level 5:
- Loss of image at edges with center of defect very dark.
- Large size: >6 in (152.4 mm) long × >1 in (25.4 mm) wide.

In the above-defined measurement scale, a level 3 deletion would be satisfactory for most copying or printing applications involving print images, but would be somewhat less than satisfactory for pictorial or graphic images.

Subsequent to each production of test documents, the scorotrons were returned to the test fixture. The tests were made over a period of 500 hours. The parking deletion/time track performance of Type 304 Stainless Steel and the CDA 172 BeCu are tabulated in the following example.

EXAMPLE 1

A beryllium copper screen and a stainless steel screen are both coated with an electrodag comprising an aqueous dispersion of semicolloidal graphite in an organic binder which cures at 350° C. in one hour to form a hard conductive coating, believed to contain by weight, prior to coating the shield, 77.5% water, 14.5% aluminum oxide, 7% graphite and about 1% polyvinylpyrollidone. The electrodag is available under the designation Electrodag 121, from Acheson Colloid Company, Port Huron, Mich. The results of the test were as follows:

TABLE 1

| Time (hrs) | Deletion Level of 121 Electrodag on 304 SST | Deletion Level of 121 Electrodag on CDA 172 BeCu |
|---|---|---|
| 0 | 0 | 0 |
| 41 | 0 | 0 |
| 83 | 2 | 0 |
| 138 | 4 | 0 |
| 188 | 3 | 1 |
| 260 | 4 | 2 |
| 346 | 4 | 3 |
| 418 | 5 | 3 |
| 500 hrs | 5 | 4 |

In comparing the base materials, beryllium copper offered significant advantages over stainless steel. Stainless steel on the average started to cause deletions after 83 hours of operation. Beryllium copper, by contrast, did not cause a parking deletion until 188 hours. Beryllium copper screens offer approximately a two fold deletion improvement over stainless steel while having excellent flatness characteristics and potentially lower manufacturing cost.

It will no doubt be appreciated that the present invention is equally applicable to the use of beryllium copper in screens or grids formed as wire mesh arrangements, wherein a wire or wires of the defined material are arranged in mesh-like pattern, between the coronode and the photoconductive surface. The wires may be supported on, for example, notchings in the scorotron side support members, and arranged in a pattern uniformly covering the area between the coronode and the photoconductive surface. The wire or wires forming the pattern must all be connected to the low voltage potential. Wire grid or screen scorotrons are well known in the art of electrophotography, and the use beryllium copper is believed an advantageous improvement in their construction.

The invention has been described with reference to a particular embodiment. Modifications and alterations will occur to others upon reading and understanding this specification. It is intended that all such modifications and alterations are included insofar as they come within the scope of the appended claims or equivalents thereof.

We claim:

1. A corona charging device for charging a moving charge retentive surface during operation, said charging operation producing a corona byproduct deleterious to said charge retentive surface, effecting said charge retentive surface between operations when said charge retentive surface is stationary to cause a defect in the charge retentivity characteristics of said charge retentive surface, said corona charging device comprising:

insulative support means;

coronode means supported on said support means, closely adjacent and generally parallel to a surface to be charged;

a first voltage source, connected to said coronode means for driving said coronode means to a corona generating condition;

a screen supported on said support means between said coronode means and said surface;

a second voltage source, connected to said screen for driving said screen to a potential approximating the desired potential on said surface;

said screen fabricated of a beryllium copper alloy having the characteristic of non-adsorption of said material deleterious to said charge retentive surface during operation, and consequently having the characteristic of not desorbing said deleterious material between operations.

2. A scorotron for charging a surface, including a scorotron support member, at least one coronode member supported on said scorotron support member closely adjacent to a surface to be charged during corona producing operation and connectable to a relatively high voltage source, and a screen member supported on said scorotron support member between said coronode member and said surface to be charged and connectable to a relatively low voltage source, said screen member comprising:

a generally elongated rectangular member fabricated from a beryllium copper alloy having a thin cross sectional thickness, and a grid pattern formed therein having the characteristic of non-adsorption of material deleterious to said charge retentive surface during corona producing operation, and consequently, having the characteristic of not desorbing said deleterious material between corona producing operations.

3. A scorotron screen member for use in a corona charging device producing corona for charging a charge retentive surface during operation thereof, said screen comprising:

a generally rectangular member having a thin cross-sectional thickness and fabricated from a beryllium copper alloy having the characteristic of non-adsorption of material deleterious to said charge retentive surface produced during corona production, and consequently having the characteristic of not desorbing said deleterious material between corona producing operations and adapted to be supported between a corona generating member and a surface to be charged;

said member having a generally planar portion;

said planar portion including a grid portion having a number of openings through said cross-sectional thickness of said member defined therein, said openings forming an open area in the range of approximately 40–70% of said grid portion.

4. The scorotron screen as defined in claim 3 wherein said member is fabricated by a first perforating step and a second heat treating stress reduction step.

5. The scorotron screen as defined in claim 3 wherein said member is fabricated by a first perforating step and a second heat treating stress reduction step and a subsequent forming step.

6. The scorotron screen as defined in claim 3 wherein said beryllium copper alloy ranges from about 0.1% to 2.0% beryllium.

7. The scorotron screen as defined in claim 3 wherein said screen is coated with an electrodag coating having a reactive metal base.

* * * * *